US010490019B2

(12) United States Patent
Sugiyama

(10) Patent No.: US 10,490,019 B2
(45) Date of Patent: Nov. 26, 2019

(54) LEVER HANDLE AND GAME MACHINE

(71) Applicant: OMRON Corporation, Kyoto-shi, Kyoto (JP)

(72) Inventor: Hiroaki Sugiyama, Hashima-gun (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/754,307

(22) PCT Filed: Nov. 15, 2016

(86) PCT No.: PCT/JP2016/083810
§ 371 (c)(1),
(2) Date: Feb. 22, 2018

(87) PCT Pub. No.: WO2017/104333
PCT Pub. Date: Jun. 22, 2017

(65) Prior Publication Data

US 2018/0286173 A1 Oct. 4, 2018

(30) Foreign Application Priority Data

Dec. 16, 2015 (JP) ..... 2015-245566

(51) Int. Cl.
*G07F 17/34* (2006.01)
*G07F 17/32* (2006.01)

(52) U.S. Cl.
CPC ..... *G07F 17/3209* (2013.01); *G07F 17/3211* (2013.01); *G07F 17/34* (2013.01)

(58) Field of Classification Search
CPC .... A63F 5/04; G07F 17/3209; G07F 17/3211; G07F 17/3213; G07F 17/34
See application file for complete search history.

(56) References Cited

U.S. PATENT DOCUMENTS 5,803,453 A * 9/1998 Stephan ..... G07F 17/3209 273/138.2
10,031,274 B2 * 7/2018 Muraoka ..... G02B 6/0036
(Continued)

FOREIGN PATENT DOCUMENTS

JP 2002-102414 A 4/2002
JP 2012-100875 A 5/2012
(Continued)

OTHER PUBLICATIONS

English translation of the International Search Report of PCT/JP2016/083810 dated Dec. 20, 2016.
(Continued)

*Primary Examiner* — Raleigh W Chiu
(74) *Attorney, Agent, or Firm* — Metrolex IP Law Group, PLLC

(57) ABSTRACT

A lever handle includes a body portion that has a plate shape and is attached to a game machine so as to be able to rotationally move between a home position and a stroke end around a rotary shaft main body provided at one end, and a main light-show portion for causing the body portion to emit light. The main light-show portion includes a light source, and a light guide plate having a light incident face on which light from the light source is incident and a light exit face from which light from the light incident face exits, and includes, as the light guide plate, a light guide plate on which a reflection pattern for causing light in one of a character shape or a diagram shape to exit from the light exit face is formed.

8 Claims, 5 Drawing Sheets

(56) References Cited

U.S. PATENT DOCUMENTS

| | | | | |
|---|---|---|---|---|
| 2009/0239604 | A1* | 9/2009 | Acres | G07F 17/32 463/16 |
| 2012/0115563 | A1 | 5/2012 | Kido et al. | |
| 2012/0149468 | A1* | 6/2012 | Menheere | G07F 17/3209 463/37 |
| 2013/0252709 | A1* | 9/2013 | Lee | G02F 1/133615 463/20 |
| 2015/0094154 | A1* | 4/2015 | Sugiyama | G07F 17/3213 463/47 |
| 2016/0027239 | A1 | 1/2016 | Kido et al. | |
| 2016/0377792 | A1* | 12/2016 | Muraoka | G02B 6/0036 362/626 |
| 2018/0286173 | A1* | 10/2018 | Sugiyama | G07F 17/34 |

FOREIGN PATENT DOCUMENTS

| | | | |
|---|---|---|---|
| JP | 2015-66348 | A | 4/2015 |
| JP | 2015-213565 | A | 12/2015 |

OTHER PUBLICATIONS

English translation of the Written Opinion of PCT/JP2016/083810 dated Dec. 20, 2016.

* cited by examiner

LEVER HANDLE AND GAME MACHINE

TECHNICAL FIELD

The present invention relates to a lever handle and a game machine.

RELATED ART

Game machines called slot machines are conventionally known. In the slot machine, a plurality of reels on which various kinds of symbols are displayed rotate, a winning combination is determined based on whether and how the same symbols appear and what that symbol is when rotation stops, and an award is given in accordance with the winning combination and the number of bets.

The reels start to rotate upon a button provided on the slot machine being pressed, or a lever handle arranged on a housing side face being pulled down. Conventionally, this lever handle is a simple one in which a resin handle knob is simply arranged at a leading end of a metal pipe, whereas a lever handle in which the handle knob emits light has been developed, as described in Patent Document 1, for example.

RELATED ART DOCUMENTS

Patent Documents

Patent Document 1: JP H2002-102414A

SUMMARY OF THE INVENTION

Problem to be Solved by the Invention

However, although such a conventional technique in Patent Document 1 can be expected to have a theatrical effect on the player who is playing a game, an appealing effect on surrounding players cannot be expected due to the light-emitting portion being small, and there is a demand for a function that can attract the attention of players who are passing nearby.

The present invention has been made in view of the foregoing problem, and aims to realize a lever handle capable of also appealing to surrounding players by means of a light-show effect, and a game machine that includes this lever handle.

Means for Solving the Problems

To achieve the above-stated object, a lever handle includes: a body portion that has a plate shape and is attached to a main body apparatus so as to be able to rotationally move between a home position and a stroke end around a rotary shaft main body provided at one end; and a main light-show portion configured to cause the body portion to emit light, wherein the main light-show portion includes a light source, and a light guide plate having a light incident face on which light from the light source is incident and a light exit face from which light from the light incident face exits, and, includes, as the light guide plate, a first light guide plate on which a reflection pattern configured to cause light in one of a character shape or a diagram shape to exit from the light exit face is formed.

Also, to achieve the above-stated objects, a game machine according to the present invention includes the above-described lever handle.

Effects of the Invention

An aspect of the present invention has an effect of also appealing to surrounding players by means of a light-show effect.

EMBODIMENTS OF THE INVENTION

An embodiment of the present invention will now be described with reference to the drawings. In the following description, like components are assigned like signs. Names and functionalities thereof are also the same. Accordingly, detailed descriptions thereof are not repeated.

Figure 1:
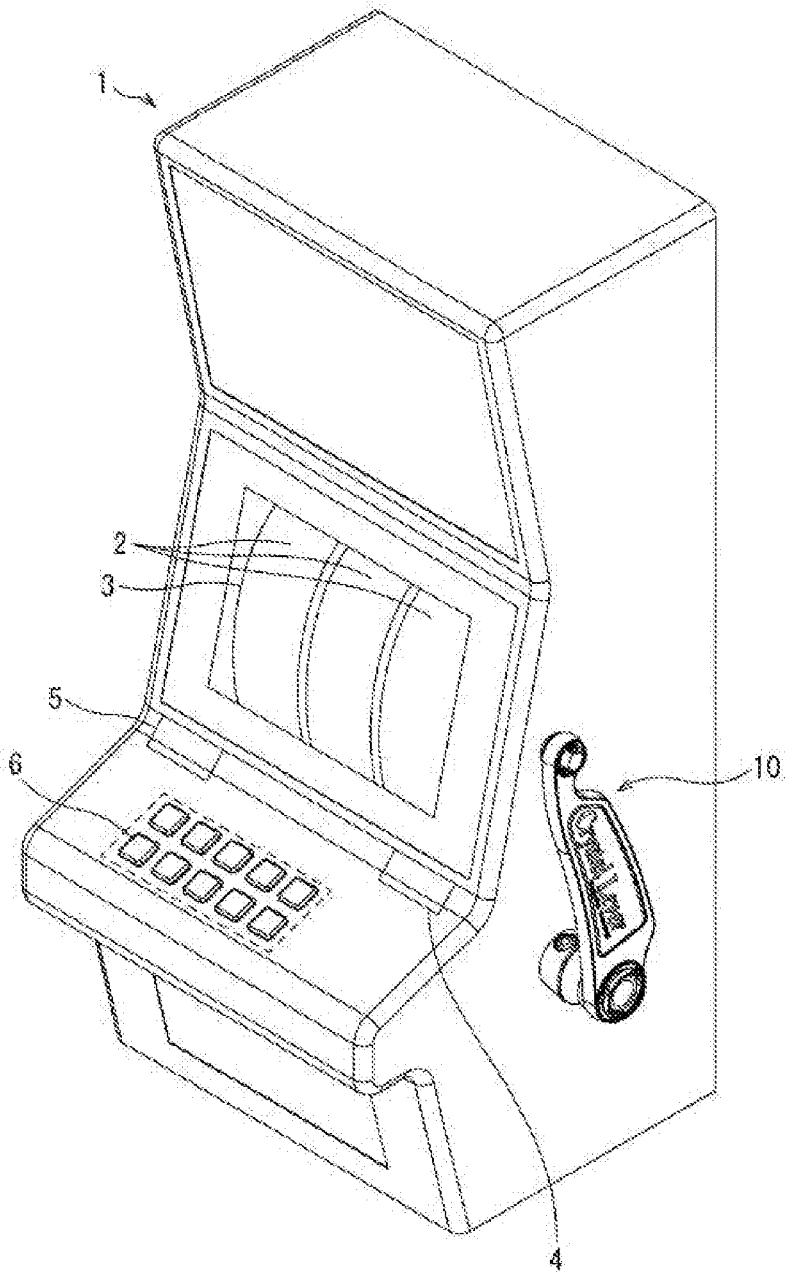
FIG. 1 is an external appearance perspective view showing a slot machine, which serves as an example of a game machine according to an embodiment.

FIG. 1 is an external appearance perspective view showing a slot machine, which serves as an example of a game machine according to an embodiment. As shown in FIG. 1, a slot machine 1 includes a reel portion 2, which is arranged in an upper portion of a housing, a bill insertion slot 4, a ticket issuing port 5, a switch unit 6, which is arranged near the reel portion 2, and a lever handle 10, which is provided on a housing side face. A bill is inserted into the bill insertion slot 4 of the slot machine 1, and after play ends, the slot machine 1 discharges a ticket from the ticket issuing port 5 if conditions under which an award can be received were satisfied during play.

The reel portion 2 includes a plurality of reels that are arranged next to each other in a lateral direction, and play starts upon the reels rotating as a result of the lever handle 10 being pulled down. A plurality of kinds of symbols are displayed on each reel, and a player can receive an award in accordance with the winning combination that is specified based on whether and how the same symbols appear when all reels are stopped under automatic control. Note that the reel portion 2 may also include the reels themselves, or may be configured so that something that corresponds to reels is displayed on a display screen 3. The switch unit 6 includes a button for increasing or reducing the number of bets during play, a check button, a return button, and so on.

Figure 2:
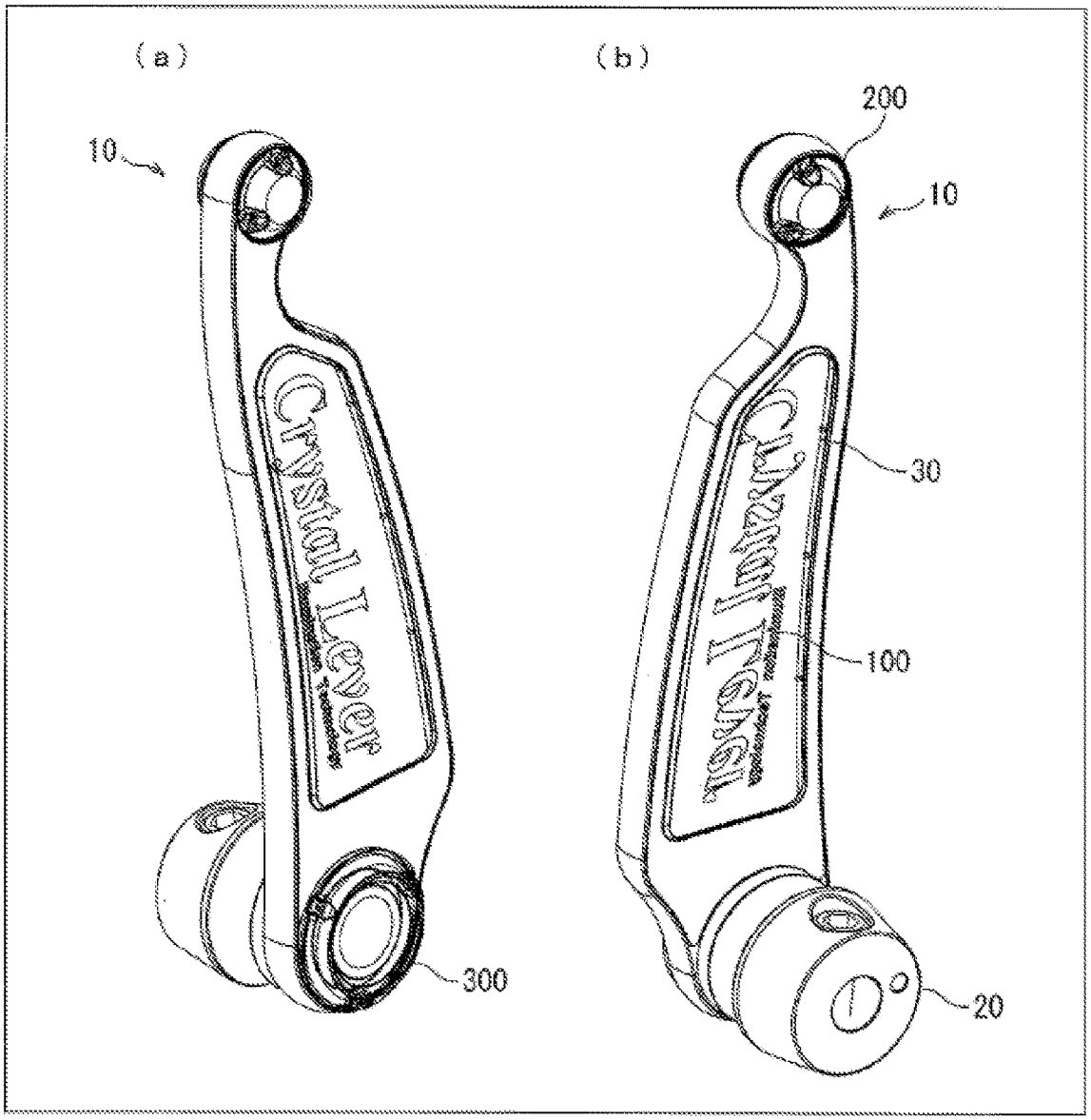
FIG. 2 shows external appearance perspective views of a lever handle.
Figure 3:
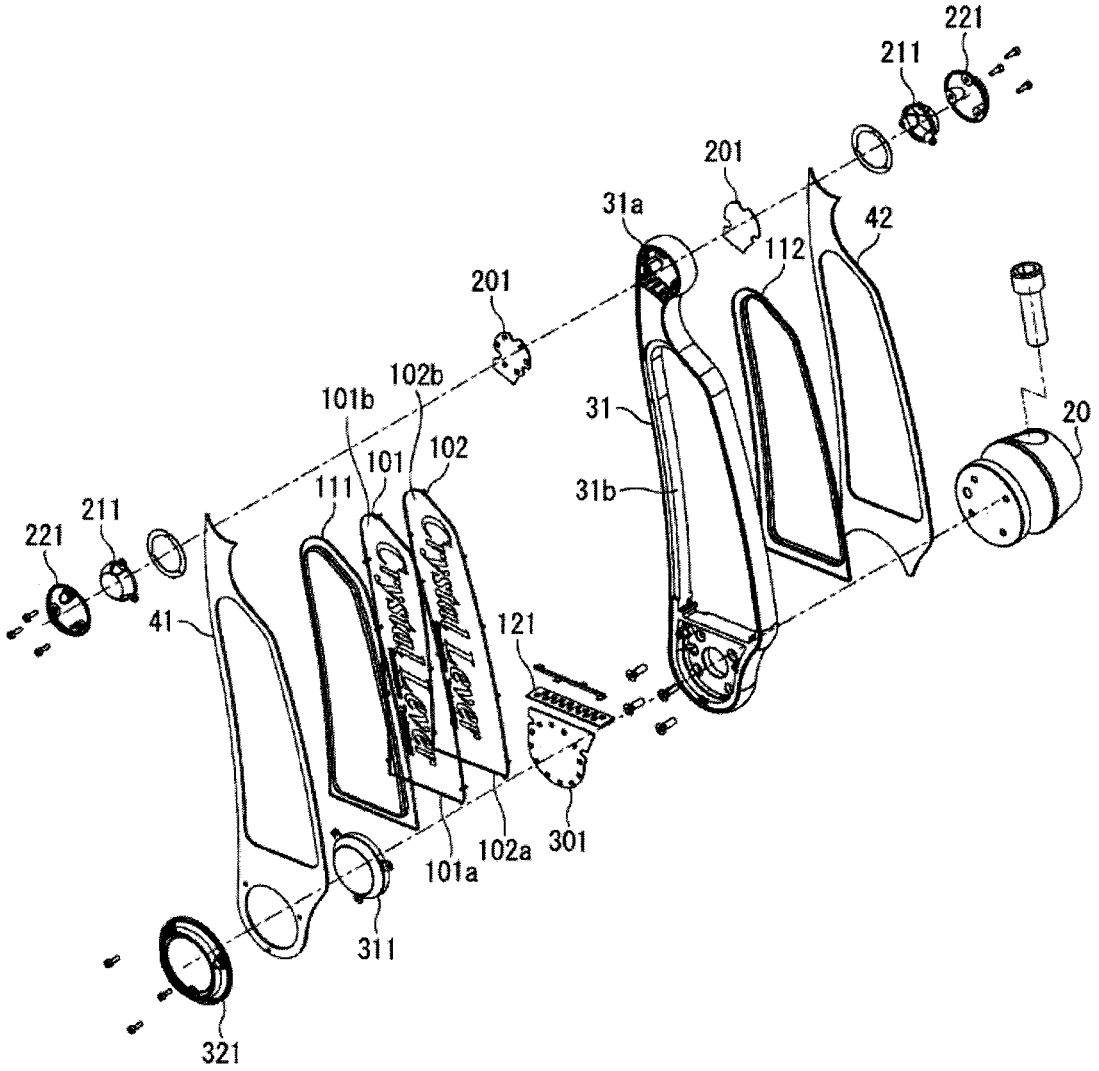
FIG. 3 is an exploded perspective view of the lever handle.

FIGS. 2(*a*) and 2(*b*) are external appearance perspective views of the lever handle, and FIG. 3 is an exploded perspective view of the lever handle. As shown in FIGS. 2(*a*), 2(*b*), and 3, the lever handle 10 has substantially an L-shape, and includes a rotary shaft main body 20, which is attached to the housing side face of the slot machine 1, a body portion 30, which is substantially perpendicular to the rotary shaft main body 20, and a main light-show portion 100 and first and second sub-light-show portions 200 and 300, which are provided in the body portion and have a light-show effect. Play starts upon the body portion 30 rotating and moving from a home position to a stroke end around the rotary shaft body 20.

The body portion 30 includes a main frame 31, which has a plate shape, and main frame covers 41 and 42. The handle knob portions, which are the first sub-light-show portions 200, are provided in the main frame 31 so as to be fitted into a small frame 31*a* that is located at one end, and the rotary shaft main body 20 is attached to the other end. The second sub-light-show portion (rotary shaft light-show portion) 300 is provided on the side opposite to the face to which the rotary shaft main body 20 is attached. The main light-show portion 100 is provided in a large frame 31*b* between the first and second sub-light-show portions 200 and 300.

The main light-show portion 100 is constituted by light guide plates 101 and 102, light guide plate covers 111 and 112, and an LED substrate 121, which includes LEDs. The light guide plates 101 and 102 and the LED substrate 121 are fitted into the large frame 31*b*, and are covered by the light guide plate covers 111 and 112 so that the light guide plates 101 and 102 and the LED substrate 121 are held therebetween.

The light guide plates 101 and 102 are made of a translucent material, such as an acrylic resin or polycarbonate, for example. The light guide plates 101 and 102 are arranged substantially parallel to the housing side face of the slot machine 1, and are arranged in the large frame 31*b* so that portions of end faces of the light guide plates 101 and 102 oppose the LEDs provided on the LED substrate 121. Accordingly, the end faces of the light guide plates 101 and 102 that oppose the LEDs serve as light incident faces on which light from the LEDs is incident. A reflection pattern for emitting light that is propagated within the light guide plates 101 and 102 from an outer face (light exit face) of the slot machine 1 is formed in the light guide plates 101 and 102. In this embodiment, a reflection pattern that is constituted by character shapes ("Crystal Lever" in the diagrams) is formed in the light guide plate 101, which is arranged outward of the slot machine 1 (arranged at a position distant from the housing side face of the slot machine 1). On the other hand, a reflection pattern is formed in a region in the light guide plate 102 that is arranged inward of the light guide plate 101 (arranged at a position near the housing side face of the slot machine 1), the region opposing a region other than that of the reflection pattern in the light guide plate 101 (i.e. the region other than the characters). As a result, character portions emit light in the light guide plate 101, and light is emitted from the region not including the characters in the light guide plate 102. With this configuration, the back faces of the characters are shadows, and the characters are provided with a sense of depth.

Note that, although a configuration is employed here in which the light guide plates 101 and 102 are provided, a configuration may also be employed in which only the light guide plate 101 is provided. Three or more light guide plates may also be stacked. Furthermore, the reflection pattern formed on the light guide plates is not limited to one that is arranged in the character shape, and may also be arranged in the picture shape such as a symbol or diagram. Alternatively, a configuration may also be employed in which a reflection pattern is formed over the entire face of each light guide plate, and light is emitted from the entire light guide plate. A reflection pattern may also be formed on each light guide plate so that light propagated therewithin is emitted toward the housing side face of the slot machine 1. Thus, the light guide plates can be used as indirect lighting.

Two lines of a plurality of LEDs are linearly arranged on the LED substrate 121, and the LEDs in these lines are arranged between the large frame 31*b* of the main frame 31 and the light guide plates 101 and 102 so as to oppose light incident faces 101*a* and 102*a*, which determine (define/form) the thickness of the light guide plates 101 and 102, respectively.

The handle knob portions 200, which serve as the first sub-light-show portions, are fitted respectively into a side (back face side) of the main frame 31 that opposes the slot machine 1 and the outer side (front face side) of the slot machine 1, and exhibit the light-show effect on both sides. The two handle knob portions 200 each includes an LED substrate 201, in which LEDs are arranged in a ring shape, a dome-shaped light guide plate 211, and a dome-shaped light guide plate cover 221 for covering the dome-shaped light guide plate 211.

The dome-shaped light guide plates 211 have a substantially hemispherical shape, and light from the LEDs is incident on an end face at an edge thereof and exits from an outer curved face (light exit face). The dome-shaped light guide plate cover 221 is a transparent or translucent covering member that has a substantially hemispherical shape, positions and holds the dome-shaped light guide plate 211 in the small frame 31*a*, and allows the light exiting from the dome-shaped light guide plate 211 to be transmitted.

The second sub-light-show portion 300 includes an LED substrate 301, on which LEDs are arranged in a ring shape, a dome-shaped light guide plate 311, and a dome-shaped light guide plate cover 321 for covering the dome-shaped light guide plate 311, and is provided at a position that is on the front face side of the main frame 31 and on the side opposite to the rotary shaft main body 20.

The dome-shaped light guide plate 311 has a substantially hemispherical shape, and light from the LEDs provided on the LED substrate 301 is incident on an end face at an edge thereof, and exits from an outer curved face (light exit face). The dome-shaped light guide plate cover 321 is a transparent or translucent covering member that has a substantially hemispherical shape, positions and holds the dome-shaped light guide plate 311, and allows the light exiting from the dome-shaped light guide plate 311 to be transmitted. Note that a diffuser plate may also be used together with the dome-shaped light guide plate 311.

Main frame covers 41 and 42 are covering members for covering portions other than the inside of the large frame 31 of the main frame 31, the inside of the small frame 31*a*, the second sub-light-show portion 300, and the rotary shaft main body 20. The main light-show portion 100 and the LED substrate 121 are fitted into the large frame 31*b*, and the LED substrate 301 and the dome-shaped light guide plate 311 that is stacked on the front face of the LED substrate 301 are covered while being arranged on the front face side of the main frame 31.

The main frame cover 42 is fixed to the main frame 31 from the back face side of the main frame 31 so that an end portion of the main frame cover 42 is held between the rotary shaft main body 20 and the main frame 31. The main frame cover 41 is fixed to the main frame 31, together with the dome-shaped light guide plate cover 321 that is provided outward of the main frame cover 41, and the dome-shaped light guide plate 311 that is provided inward of the main frame cover 41, by a fixing member that is inserted from the dome-shaped light guide plate 321 to the main frame 31.

Figure 4:
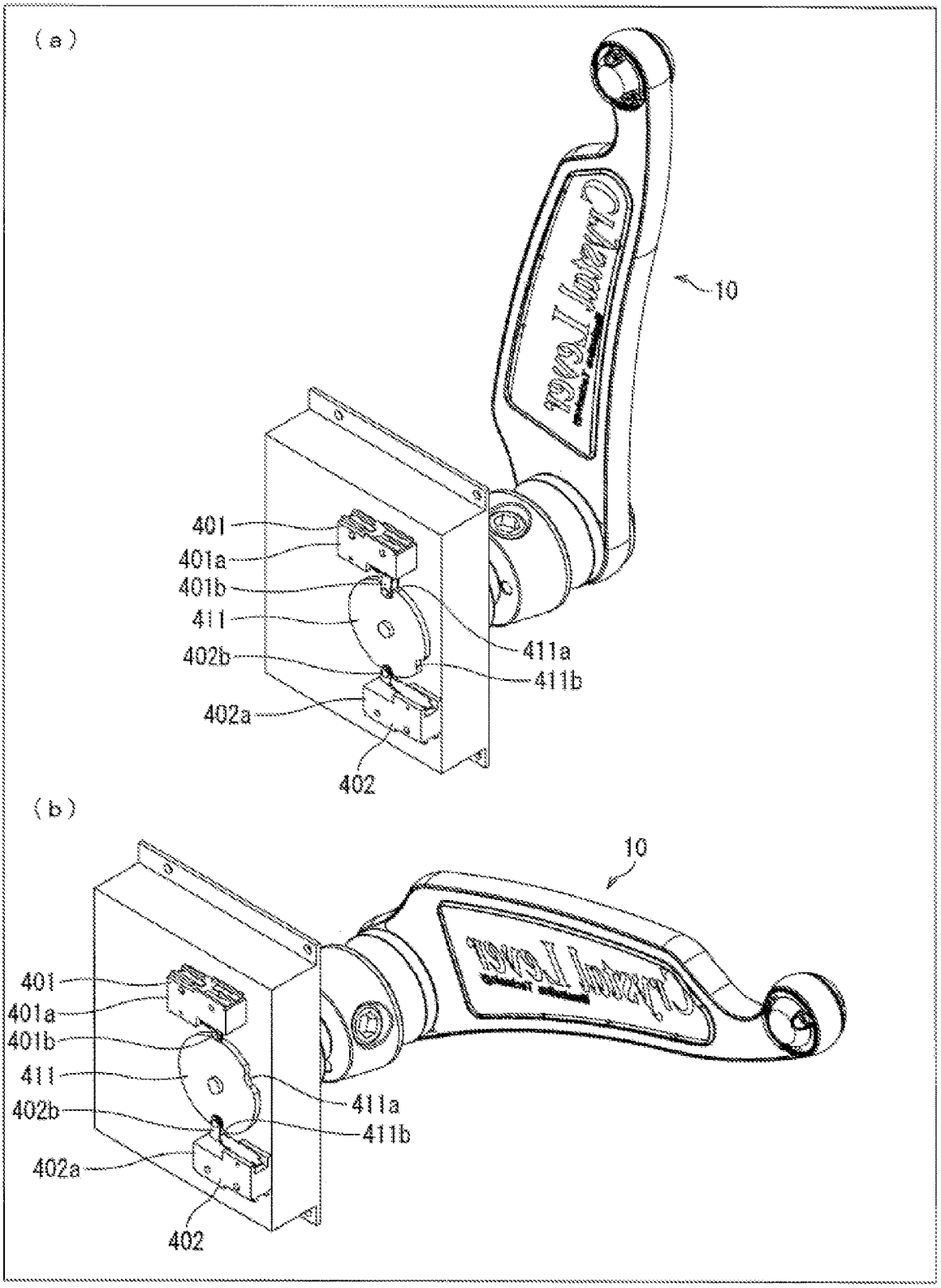
FIG. 4 shows a configuration of a ratchet unit together with the lever handle according to the embodiment.

FIGS. 4(*a*) and 4(*b*) are diagrams showing a configuration of a ratchet unit together with the lever handle according to the embodiment. FIG. 4(*a*) shows a state where the lever handle is on standby at the home position, and FIG. 4(*b*) shows a state where the lever handle has rotationally moved to the stroke end. As shown in FIGS. 4(*a*) and 4(*b*), the ratchet unit includes first and second switches 401 and 402, and a cam plate 411, which has a thin, substantially circular shape.

The first switch 401 includes a housing portion 401*a* and a projecting portion 401*b*, which has a bar shape. One end of the projecting portion 401*b* is fitted into the housing portion 401*a*, and can slide in the axial direction thereof. The projecting portion 401*b* is biased toward the other end side, is in an OFF state when not pressed into the housing portion 401*a*, and is in an ON state when pressed into the housing portion 401*a*.

Similarly, the second switch 402 includes a housing portion 402*a* and a projecting portion 402*b*, which has a bar shape. One end of the projecting portion 402*b* is fitted into the housing portion 402*a*, and can slide in the axial direction thereof. The projecting portion 402*b* is biased toward the other end side, is in an OFF state when not pressed into the housing portion 402*a*, and is in an ON state when pressed into the housing portion 402*a*.

The cam plate 411 is joined to the rotary shaft main body 20 of the lever handle 10, and rotates in conjunction with the rotation of the lever handle 10. The cam plate 411 comes into contact, at its circumferential face, with the projecting portions 401*b* and 402*b* of the first and second switches 401 and 402 that are arranged opposing each other. The cam plate 411 has cutout portions 411*a* and 411*b* at two positions in the circumferential direction, and the first and second switches 401 and 402 turn ON or OFF in accordance with a positional relationship with the cutout portions 411*a* and 411*b*, respectively.

Specifically, when the lever handle 10 is on standby at the home position, the projecting portion 401*b* of the first switch 401 is in a state of being fitted to the cutout portion 411*a* and not being pressed into the housing portion 402*a*. Thus, the first switch 401 is in an OFF state. On the other hand, the projecting portion 402*b* of the second switch 402 is in contact with the circumferential face of the cam plate 411 excluding the cutout portions 411*a* and 411*b*, and is accordingly in a state of being pressed into the housing portion 402*a*. Thus, the second switch 402 is in an ON state.

When the lever handle 10 is located at the stroke end, the projecting portion 401*b* of the first switch 401 is in contact with the circumferential face of the cam plate 411 excluding the cutout portions 411*a* and 411*b*, and is accordingly in a state of being pressed into the housing portion 401*a*. Thus, the first switch 401 is in an ON state. On the other hand, the projecting portion 402*b* of the second switch 402 is in a state of being fitted to the cutout portion 411*b* and not being pressed into the housing portion 402*a*. Thus, the second switch 402 is in an OFF state (see FIG. 4(*b*)).

Figure 5:
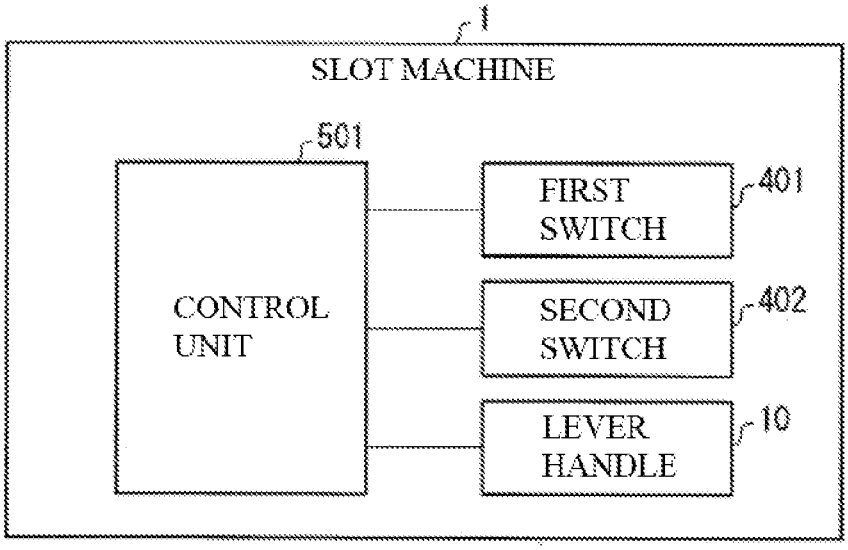
FIG. 5 is a functional block diagram showing an example of mechanisms provided in the slot machine.

FIG. 5 is a functional block diagram showing an example of functions provided in the slot machine. As shown in FIG. 5, the slot machine 1 includes the first and second switches 401 and 402, the lever handle 10, and a control unit 501, which controls the entire apparatus.

The control unit (rotational speed measurement unit) 501 controls each portion of the apparatus in accordance with signals output by the first and second switches (detection units) 401 and 402. The control unit 501 detects that the lever handle 10 is located at the home position when the first switch 401 is in an OFF state and the second switch 402 is in an ON state, and detects that the lever handle 10 is located at the stroke end when the first switch 401 is in an ON state and the second switch 402 is in an OFF state. The control unit 501 also detects the speed when the lever handle 10 rotationally moves from the home position to the stroke end, based on a time difference in the switching of the first and second switches 401 and 402 between ON and OFF.

The control unit 501 controls light emission of the main light-show portion 100 and the first and second sub-light-show portions 200 and 300 of the lever handle 10. For example, when the control unit 501 detects that the lever handle 10 has rotationally moved from the home position to the stroke end, the control unit 501 controls at least one of the main light-show portion 100 and the first and second sub-light-show portions 200 and 300 of the lever handle 10. Here, the light emission intensity may be made to be different between when the lever handle 10 is located at the home position and when it is located at the stroke end, and various modes, such as a mode in which the light-show portions blink in either case, are possible.

The control unit 501 may also change the rotational speed of the reel portion 2 in accordance with the speed at which the lever handle 10 has rotationally moved from the home position to the stroke end.

As described above, the lever handle 10 according to this embodiment includes the body portion 30 that has a plate shape and is attached to the slot machine 1 so as to be able to rotationally move between the home position and the stroke end around the rotary shaft main body 20 provided at one end, and the main light-show portion 100 for causing the body portion 30 to emit light. The main light-show portion 100 includes the LEDs, and the light guide plate that has the light incident face 101*a* on which light from these LEDs is incident and the light exit face 101*b* from which the light from the light incident face 101*a* exits, and includes, as the light guide plate, the light guide plate 101 on which the reflection pattern for causing light in at least one of a character shape and a diagram shape to exit from the light exit face 101*b* is formed.

With this configuration, a thin, stylish configuration can be achieved by reducing the thickness of the body portion 30 by using the light guide plate 101, rather than a configuration in which a spherical portion emits light as in the conventional technique. Furthermore, even with this configuration, the size of the light emitting area can be increased. Thus, the attention of players who are passing nearby can also be attracted. Accordingly, a lever handle capable of also appealing to surrounding players by means of the light-show effect can be realized.

Also, the slot machine 1 according to this embodiment includes the cam plate 411 that is joined to the rotary shaft main body 20 and rotates in conjunction with the rotation of the rotary shaft main body 20, the detection unit (first and second switches 401 and 402) for detecting the rotational position of the cam plate 411, and the rotational speed measurement unit (control unit 501) for measuring the rotational speed of the lever handle 10 based on a time difference between when the detection unit detects a first position and when the detection unit thereafter detects a second position, the first position being the rotational position of the cam plate 411 when the lever handle 10 is located at the home position (the position at which the first switch 401 turns OFF and the second switch 402 turns ON), and the second position being the rotational position of the cam plate 411 when the lever handle 10 is located at the stroke end (the position at which the first switch 401 turns ON and the second switch 402 turns OFF).

SUMMARY

A lever handle in an aspect of the present invention includes: a body portion that has a plate shape and is attached to a main body apparatus so as to be able to rotationally move between a home position and a stroke end around a rotary shaft main body provided at one end; and a main light-show portion configured to cause the body portion to emit light, wherein the main light-show portion includes a light source, and a light guide plate having a light incident face on which light from the light source is incident and a light exit face from which light from the light incident face exits, and, includes, as the light guide plate, a first light guide plate on which a reflection pattern configured to cause light in one of a character shape or a diagram shape to exit from the light exit face is formed.

With this configuration, a thin, stylish configuration can be achieved by reducing the thickness of the body portion by using the light guide plate, rather than a configuration in which a spherical portion emits light as in the conventional technique. Furthermore, even with this configuration, a large light emitting area can be secured. Thus, the attention of players who are passing nearby can also be attracted. Accordingly, a lever handle capable of also appealing to surrounding players by means of the light-show effect can be realized.

Also, in the lever handle in an aspect of the present invention, the main light-show portion further includes, as the light guide plate, a second light guide plate that is stacked so that the light exit face of the second light guide plate faces in the same direction as the light exit face of the first light guide plate, and a reflection pattern is formed in a region of the second light guide plate, the region opposing a region of the first light guide plate in which the reflection pattern is not formed.

With this configuration, the character or diagram can be provided with a sense of depth as a result of shade being formed in the background of the light-emitting characters or diagrams.

Also, in the lever handle in an aspect of the present invention, the light guide plate is arranged so that the light exit face faces outward of the main body apparatus.

This configuration can further increase the light-show effect.

Also, a game machine in an aspect of the present invention includes the above-described lever handle.

With this configuration, a game machine capable of also appealing to surrounding players by the light-show effect can be realized.

Also, the game machine in an aspect of the present invention further includes: a cam plate that is joined to the rotary shaft main body and rotates in conjunction with rotation of the rotary shaft main body; a detection unit configured to detect a rotational position of the cam plate; and a rotational speed measurement unit configured to measure a rotational speed of the lever handle based on a time difference between when the detection unit detects a first position and when the detection unit thereafter detects a second position, the first position being a rotational position of the cam plate when the lever handle is located at the home position, and the second position being a rotational position of the cam plate when the lever handle is located at the stroke end.

Also, the game machine in an aspect of the present invention further includes a light emission control unit configured to control light emission of the main light-show portion, based on the rotational speed measured by the rotational speed measurement unit.

This configuration enables a variety of light-show, and can accordingly further increase the light-show effect.

INDEX TO THE REFERENCE NUMERALS

1 . . . slot machine (main body apparatus), 10 . . . lever handle, 20 . . . rotary shaft main body, 30 . . . body portion, 100 . . . main light-show portion, 101, 101, 102, 102 . . . light guide plate (first light guide plate, second light guide plate), 200 . . . first sub-light-show portion (handle knob portion), 300 . . . second sub-light-show portion (rotation shaft light-show portion), 401, 402 . . . first and second switches (detection unit), 411 . . . cam plate, 411*a*, 411*b* . . . cutout portion, 501 . . . control unit (rotational speed measurement unit)

The invention claimed is:

1. A game machine comprising:

a lever handle comprising:

a body portion that has a plate shape and is attached to a main body apparatus so as to be able to rotationally move between a home position and a stroke end around a rotary shaft main body provided perpendicular to the body portion at one end; and a main light-show portion configured to cause the body portion to emit light;

a cam plate that is joined to the rotary shaft main body and rotates in conjunction with rotation of the rotary shaft main body;

a switch configured to detect a rotational position of the cam plate; and a rotational speed measurement unit configured to measure a rotational speed of the lever handle based on a time difference between when the switch detects a first position and when the switch thereafter detects a second position, the first position being the rotational position of the cam plate when the lever handle is located at the home position, and the second position being the rotational position of the cam plate when the lever handle is located at the stroke end, wherein the main light-show portion comprises a light source, and a light guide plate having a light incident face on which light from the light source is incident and a light exit face from which light from the light incident face exits, and, comprises, as the light guide plate, a first light guide plate on which a reflection pattern configured to cause light in one of a character shape or a diagram shape to exit from the light exit face is formed.

2. The game machine according to claim 1, wherein the main light-show portion further comprises, as the light guide plate, a second light guide plate that is stacked so that a light exit face of the second light guide plate faces in a same direction as a light exit face of the first light guide plate, the reflection pattern comprises a first reflection pattern, and a second reflection pattern comprises a region of the second light guide plate, the region opposing a region of the first light guide plate in which the first reflection pattern is not formed.

3. The game machine according to claim 2, further comprising:

a light emission control unit configured to control light emission of the main light-show portion, based on the rotational speed measured by the rotational speed measurement unit.

4. The game machine according to claim 2, wherein the light guide plate is arranged so that the light exit face faces outward of the main body apparatus.

5. The game machine according to claim 4, further comprising:

a light emission control unit configured to control light emission of the main light-show portion, based on the rotational speed measured by the rotational speed measurement unit.

6. The game machine according to claim 1, wherein the light guide plate is arranged so that the light exit face faces outward of the main body apparatus.

7. The game machine according to claim 6, further comprising:

a light emission control unit configured to control light emission of the main light-show portion, based on the rotational speed measured by the rotational speed measurement unit.

8. The game machine according to claim 1, further comprising:

a light emission control unit configured to control light emission of the main light-show portion, based on the rotational speed measured by the rotational speed measurement unit.

* * * * *